US005254436A

United States Patent [19]

Koga et al.

[11] Patent Number: 5,254,436

[45] Date of Patent: Oct. 19, 1993

[54] METHOD FOR IMAGE FORMATION

[75] Inventors: Masao Koga; Minoru Ohashi, both of Nagaokakyo, Japan

[73] Assignee: Mitsubishi Paper Mills Limited, Tokyo, Japan

[21] Appl. No.: 812,100

[22] Filed: Dec. 23, 1991

[30] Foreign Application Priority Data

Dec. 27, 1990 [JP] Japan ..... 2-414658

[51] Int. Cl.[5] ..... G03C 1/06

[52] U.S. Cl. ..... 430/264; 430/598; 430/435; 430/484; 430/268

[58] Field of Search ..... 430/264, 598, 435, 484, 430/268

[56] References Cited

U.S. PATENT DOCUMENTS

| | | | |
|---|---|---|---|
| 4,221,857 | 9/1980 | Okutsu et al. | 430/264 |
| 4,686,167 | 8/1987 | Resnick et al. | 430/264 |
| 5,124,230 | 6/1992 | Okamura et al. | 430/598 |
| 5,132,201 | 7/1992 | Yagihara et al. | 430/264 |

*Primary Examiner*—Richard L. Schilling
*Assistant Examiner*—Thomas R. Neville
*Attorney, Agent, or Firm*—Cushman, Darby & Cushman

[57] ABSTRACT

The present invention provides a method for image formation which is free from the problems such as uneven development and pepper fog and can give photographic characteristics of extremely high contrast negative tone using a stable developer and which comprises developing a silver halide photographic light-sensitive material in the presence of a compound represented by the following formula (I):

(I)

wherein $R_1$ represents an alkyl group of 1–8 carbon atoms or a cycloalkyl group having 4–8 carbon atoms in the ring; $R_2$, $R_3$ and $R_4$ may be identical or different and each represents a hydrogen atom, an alkyl group, an aralkyl group, an aryl group or a heterocyclic group with a proviso that they cannot be simultaneously hydrogen atoms, $R_2$ and $R_3$ may link to each other to form a ring structure, and at least one hydroxy group is present in the substituents $R_2$, $R_3$ and $R_4$.

7 Claims, No Drawings

METHOD FOR IMAGE FORMATION

BACKGROUND OF THE INVENTION

The present invention relates to a method for development of silver halide photographic light-sensitive materials and particularly, to a photographic light-sensitive material which can provide a very high contrast negative image, a high sensitivity negative image and a good dot image quality.

To add hydrazine compounds to a silver halide photographic emulsion or a developer has been known, for example, in U.S. Pat. Nos. 3,730,727 (a developer comprising combination of ascorbic acid and hydrazine), U.S. Pat. No. 3,227,552 (use of hydrazine as an auxiliary developer for obtaining directly a positive color image), U.S. Pat. No. 3,386,831 (addition of β-monophenylhydrazide of aliphatic carboxylic acids as a stabilizer for silver halide light-sensitive materials), and U.S. Pat. No. 2,419,975, and Mees. "The Theory of Photographic Process", the third edition (1966), page 281.

Among them, especially U.S. Pat. No. 2,419,975 discloses formation of high contrast negative images by addition of hydrazine compounds. That is, it discloses that when a hydrazine compound is added to silver chlorobromide emulsion and development is carried out with a developer of higher pH of 12.8, very high contrast photographic characteristics of more than 10 in gamma value (γ) can be obtained. However, highly alkaline developers having a pH value close to 13 are susceptible to oxidation with air and unstable and cannot stand long-term storage or use. The super-high contrast photographic characteristics of more than 10 in gamma value are very useful for photographic reproduction of continuous tone images by means of dot images useful for printing plate making or for reproduction of line images For such purpose, hitherto, a silver chlorobromide emulsion containing more than 50 mol%, preferably more than 75 mol% of silver chloride has been used and development has been conducted with a hydroquinone developer having very low effective concentration (normally 0.1 mol/l or less) of sulfite ion (lith development). However, according to this method, since concentration of sulfite ion in the developer is low, the developer is extremely unstable and cannot be stored for more than 3 days. Besides, all of the above methods must use silver chlorobromide emulsions of relatively high silver chloride content and thus, high sensitivity has not been able to be obtained. Therefore, it has been earnestly desired to obtain super-high contrast photographic characteristics useful for reproduction of dot images or line images by using emulsions of high sensitivity and stable developers.

U.S. Pat. Nos. 4,168,977, 4,224,401, 4,243,739, 4,269,929, 4,272,614, and 4,323,643 disclose silver halide photographic light-sensitive materials which give very high contrast negative photographic characteristics using stable developers, but it has come to be known that acylhydrazine compounds used therein have some defects. That is, these hydrazines have been known to generate nitrogen gas during development and this gas is collected in the film to form bubbles, which may damage photographic images. Therefore, there have been demanded such compounds as giving very high contrast photographic characteristics even with small addition amount for diminishing generation of the bubbles and besides reduction of production cost for lightsensitive materials. Moreover, if development is continued using these hydrazines, innumerable circular fogs (pepper fogs) often occur in unexposed portions to seriously damage the image quality.

Moreover, the conventional hydrazines are required in a large amount for sensitization and enhancement of contrast and when especially high sensitivity of light-sensitive materials is desired, the hydrazines are preferably used in combination with other sensitizing techniques (for example, to carry out strong chemical sensitization; to increase grain size; and to add the compounds which accelerate sensitization as disclosed in U.S. Pat. Nos. 4,272,606 and 4,241,164). However, employment of these sensitizing techniques in combination with the hydrazines, sometimes sensitization with time and increase of fog occur during storage. Furthermore, when development is conducted using the conventional hydrazines, so-called uneven development caused by uneven agitation of developer is liable to occur. This uneven development conspicuously occurs in development by automatic processor and when development is strengthened in order to avoid this phenomenon, there occurs the above-mentioned pepper fogging. Therefore, the compounds have been demanded which are free from the problem in stability with time, uneven development and pepper fog, are effective with addition of them in a small amount, and besides are easy in synthesis.

SUMMARY OF THE INVENTION

A first object of the present invention is to provide a silver halide photographic light-sensitive material which can give photographic characteristics of very high contrast negative tone of more than 10 in gamma value by using a stable developer.

A second object of the present invention is to provide a negative type silver halide photographic light sensitive material containing hydrazines which can give good image quality without uneven development or pepper fogging.

A third object of the present invention is to provide a negative type silver halide photographic light-sensitive material containing hydrazines which can give desired very high contrast negative tone photographic characteristic with a small addition amount without giving adverse effect on photographic performance.

A fourth object of the present invention is to provide a method for developing a silver halide photographic light-sensitive material in high contrast state by adding hydrazines which can give superior processing stability (for example, no uneven development and no pepper fog) and rapid and high contrast photographic characteristics.

The above objects have been attained by developing a silver halide photographic light-sensitive material in the presence of a compound represented by the following formula (I):

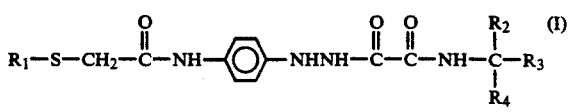

(I)

wherein $R_1$ represents an alkyl group of 1–8 carbon atoms or a cycloalkyl group having 4–8 carbon atoms in the ring, $R_2$, $R_3$ and $R_4$ may be identical or different and each represents a hydrogen atom, an alkyl group, an aralkyl group, an aryl group or a heterocyclic group with a proviso that they cannot be simultaneously hydrogen atoms, $R_2$ and $R_3$ may link to each other to form a ring structure, and at least one hydroxy group is present in the substituents $R_2$, $R_3$ and $R_4$.

The alkyl group represented by $R_1$ in the formula (I) is preferably an alkyl group of 4–8 carbon atoms and may have a substituent such as, for example, a hydroxy group, a halogen atom, a substituted amino group, an aryl group, a mercapto group or an alkyl group of 1–3 carbon atoms.

The cycloalkyl group represented by $R_1$ in the formula (I) may have the same substituent as enumerated above for the alkyl group.

The alkyl group represented by $R_2$, $R_3$ and $R_4$ in the formula (I) is preferably an alkyl group of 15 or less carbon atoms which may have a substituent such as, for example, a hydroxy group, a carboxyl group, a halogen atom, a cyano group, an alkoxy group, an aryloxy group, an aryl group, a sulfo group, or a substituted amino group.

The aralkyl group represented by $R_2$, $R_3$ and $R_4$ in the formula (I) is preferably an aralkyl group of 15 or less carbon atoms and typical examples thereof are benzyl and phenethyl groups which may have substituent.

The aryl group represented by $R_2$, $R_3$ and $R_4$ in the formula (I) is preferably an aryl group of 15 or less carbon atoms and typical examples thereof are phenyl and naphthyl groups which may have substituent.

The heterocyclic group represented by $R_2$, $R_3$ and $R_4$ in the formula (I) is preferably a nitrogen-containing heterocyclic group and typical examples thereof are pyridyl, piperidinyl, pyrazinyl, piperazinyl, pyrimidinyl, pyridazinyl, quinolyl, isoquinolyl, naphthyridinyl, quinoxalinyl, quinazolinyl, cinnolinyl and pteridinyl groups which may have substituent.

Examples of the compounds represented by the formula (I) are shown below, but they never limit the present invention.

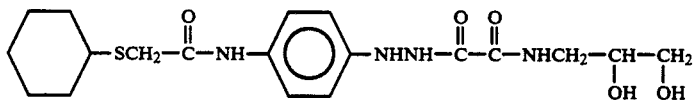

Compound (1)

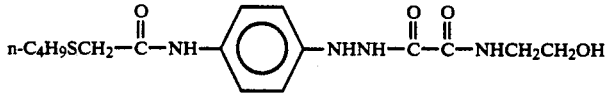

Compound (2)

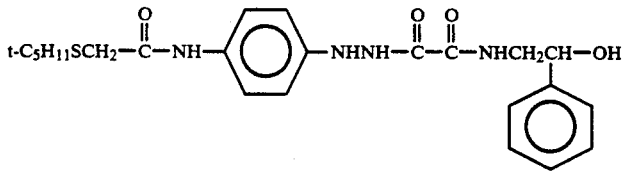

Compound (3)

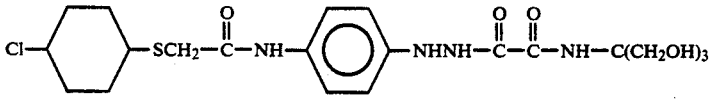

Compound (4)

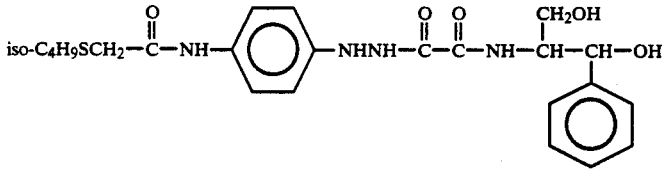

Compound (5)

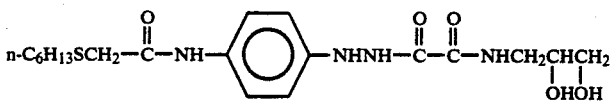

Compound (6)

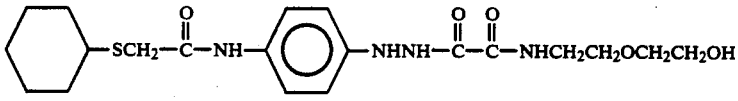

Compound (7)

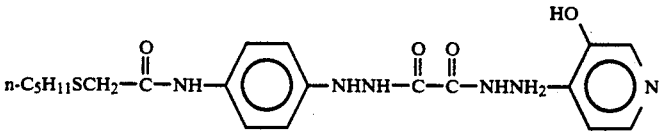

Compound (8)

-continued
Compound (9)
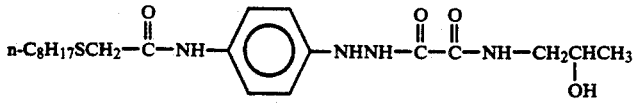
Compound (10)
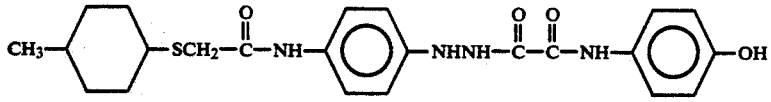
Compound (11)
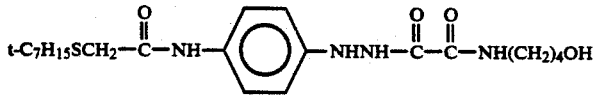
Compound (12)
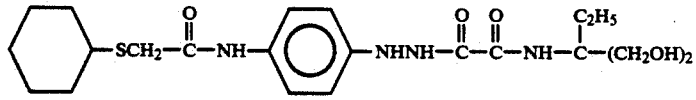
Compound (13)
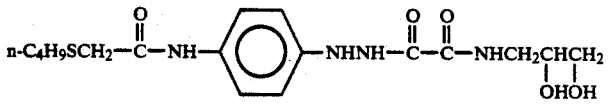
Compound (14)
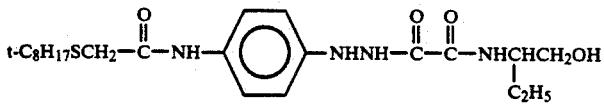
Compound (15)
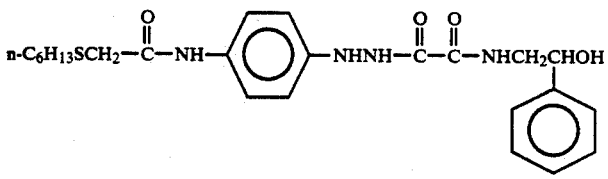
Compound (16)
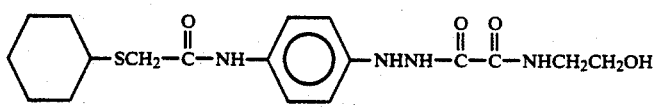
Compound (17)
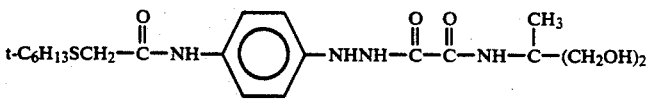
Compound (18)
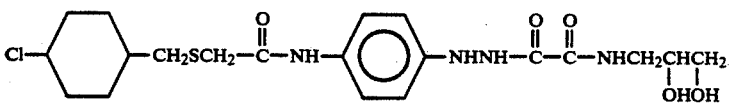
Compound (19)
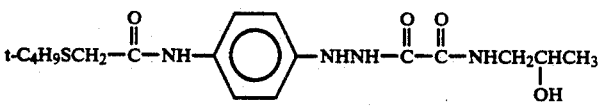
Compound (20)
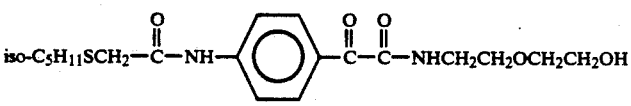
Process for synthesis of the present compounds will be explained by the following synthesis example.

Preparation of Compound (1) Scheme of synthesis is shown below.

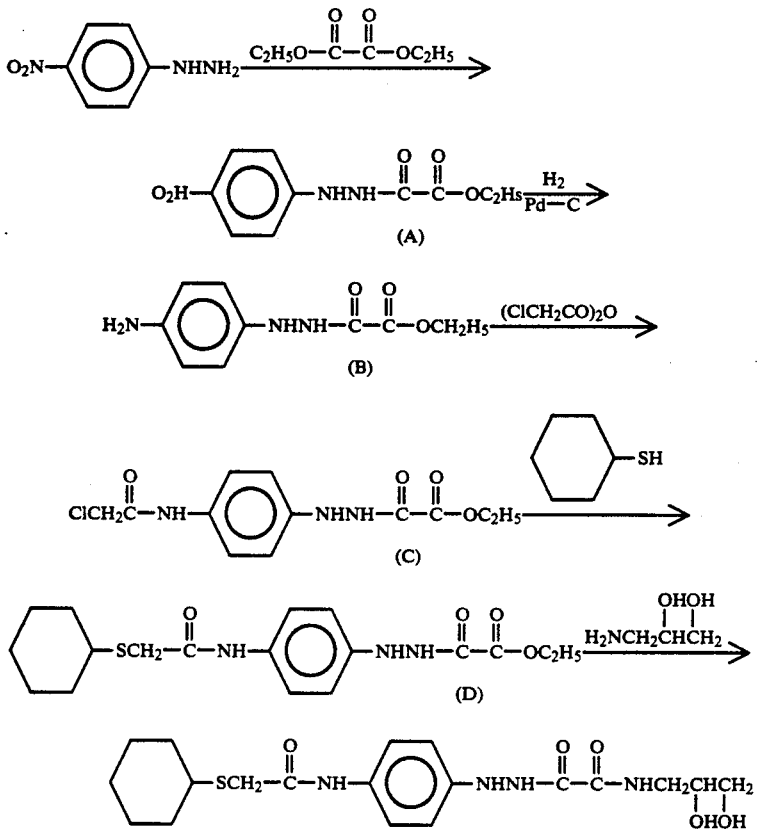

Compound (1)

15.3 g of p-nitrophenylhydrazine and 50 ml of diethyl oxalate were mixed and the mixture was heated on a water bath for 5 hours. After cooling, the precipitated crystal was collected by filtration and washed with ethanol to obtain 20.9 g of compound (A), m.p. 178°-179° C.

Then, 10.0 g of the compound (A) was dissolved in 600 ml of ethanol and subjected to catalytic reduction in the presence of Pd/C catalyst to obtain 8.1 g of compound (B), m.p. 102° C. (dec.).

Then, 2.2 g of the compound (B) was dissolved in 30 ml of DMF. To the solution was added 0.9 g of sodium acetate and then 1.7 g of monochloroacetic anhydride was added thereto over a period of 10 minutes with stirring at room temperature. The solution was stirred at room temperature for 30 minutes and insoluble matter was removed by filtration. The filtrate was concentrated under reduced pressure and water was added to the residue. The crystal was collected by filtration and washed with ethanol to obtain compound (C). m.p. 157° C. (dec.).

Next, 1.0 g of cyclohexanethiol was dissolved in 20 ml of DMF and 0.4 g of sodium hydride (60% oil suspension) was added to the solution under cooling with ice and sodium chloride and with stirring, and thereafter the compound (C) was added thereto over a period of 10 minutes. After stirring for 3 hours at the even temperature, the reaction mixture was added to ice water and the precipitated crystal was collected by filtration and washed with ethanol to obtain 1.4 g of compound (D), m.p. 167°-169° C.

Then, 20 ml of ethanol was added to 0.4 g of the compound (D) and 0.1 g of 3-amino-1,2-propanediol, followed by refluxing for 5 hours and cooling after completion of reaction. The precipitated crystal was collected by filtration and washed with ethanol to obtain 0.3 g of the desired Compound (1), m.p. 201°-203° C.

The compound represented by the formula (I) in the light-sensitive materials according to the present invention is preferably contained in a surface latent image type silver halide emulsion layer, but may be contained in a hydrophilic colloid layer contiguous to the surface latent image type silver halide emulsion layer. Such hydrophilic colloid layer may be one which has any functions as long as it does not hinder diffusion of the compound represented by the formula (I) into silver halide grains. Examples of such layer are an undercoat layer, an intermediate layer, a filter layer, a protective layer and an antihalation layer.

Content in the layer of the compound represented by the formula (I) of the present invention differs depending on characteristics of silver halide emulsion used, chemical structure of the compound, and developing conditions. Therefore, suitable content can vary in a wide range, but the range of about $1\times10^{-6}$ to about $1\times10^{-2}$ mols per 1 mol of silver in the surface latent image type silver halide emulsion is practically useful.

When the hydrazine compound represented by the formula (I) is contained in a developer, the content is suitably in the range of $10^{-4}$ to $10^{-1}$ mol/l more preferably $5\times10^{-4}$ to $5\times10^{-2}$ mol/l.

Silver halides used for the light-sensitive silver halide emulsion layer of the lightsensitive materials of the present invention have no special limitation and there may be used silver chlorobromide, silver chloroiodobromide, silver iodobromide, silver bromide and the like. When silver iodobromide or silver chloroiodobromide is used, content of silver iodide is preferably 5 mol% or less. The silver halide grains have no special limitations in form, crystal hibit and size distribution, but are preferably those which have a grain size of 0.7 microns or less.

The silver halide emulsion can be enhanced in its sensitivity with gold compounds such as chloroaurates and gold trichloride, salts of noble metals such as rhodium and iridium, sulfur compounds which react with silver salts to form silver sulfide, and reducing materials such as stannous salts and amines without coarsening the grains. Furthermore, salts of noble metals such as rhodium and iridium and iron compounds such as potassium ferricyanide can be allowed to be present in physical ripening or in nucleation. Especially, addition of rhodium salts or complex salts thereof is preferred because it further promotes the effect of the present invention to attain the photographic characteristic of super-high contrast in a short developing time.

In the present invention, the surface latent image type silver halide emulsion means an emulsion which comprises silver halide grains higher in surface sensitivity than inner sensitivity and this emulsion is preferably one which has the difference between surface sensitivity and inner sensitivity as specified in U.S. Pat. No. 4,224,401. The silver halide emulsion is preferably mono-dispersed emulsion and especially preferably has the mono-dispersibility as specified in U.S. Pat. No. 4,224,401.

The silver halide emulsion used in the present invention may be spectrally sensitized with methine dyes and others. The dyes used include cyanine dyes, merocyanine dyes, composite cyanine dyes, composite merocyanine dyes, holopolar cyanine dyes, hemicyanine dyes, styryl dyes and hemioxonole dyes. Especially useful are those which belong to cyanine dyes, merocyanine dyes and composite merocyanine dyes. These sensitizing dyes may be used alone or in combination of them. Combination of sensitizing dyes is often employed for the purpose of super sensitization. The emulsion may contain, together with the sensitizing dye, a dye which per se has no spectral sensitizing action or a substance which absorbs substantially no visible light and exhibits super sensitization.

As binders or protective colloids usable in emulsion layer or intermediate layer of the light-sensitive materials of the present invention, gelation can be advantageously used, but other hydrophilic colloids may also be used. Examples of them are proteins such as gelatin derivatives, graft polymers of gelatin with other polymers, albumin, and casein; cellulose derivatives such as hydroxyethyl cellulose, carboxymethyl cellulose and cellulose sulfate; sugar derivatives such as sodium alginate and starch derivatives; and various synthetic hydrophilic polymer materials, e.g., homopolymers or copolymers such as polyvinyl alcohol, partial acetal of polyvinyl alcohol, poly-N-vinylpyrrolidone, polyacrylic acid, polymethacrylic acid, polyacrylamide and polyvinylimidazole. As gelatins, there may be used lime-treated gelatin, acid-treated gelatin, oxygen-treated gelatin as described in Bull. Soc. Sci. Phot. Japan, No. 16, P30 (1966), and besides, hydrolyzates and oxygen-decomposition products of gelatins.

The silver halide photographic emulsion used in the present invention can contain various compounds for prevention of fogging during preparation, storage or photographic processing of the light-sensitive materials or for stabilization of photographic performance. That is, there may be added various compounds which are known as antifoggants or stabilizers such as azoles, for example, benzothiazolium salts, nitroindazoles, nitroimidazoles, nitrobenzimidazoles, chlorobenzimidazoles, mercaptothiazoles, mercaptobenzothiazoles, mercaptothiadiazoles, aminotriazoles, benzotriazoles, and mercaptotetrazoles; mercaptopyrimidines, mercaptotriazines, and thioketo compounds; and azaindene. Among them, especially preferred are benzotriazoles such as 5-methylbenzotriazoles and nitroindazoles such as 5-nitroindazole. These compounds may be contained in a processing solution.

The photographic light-sensitive materials of the present invention may contain inorganic or organic hardeners in their photographic emulsion layers or other hydrophilic colloid layers. For example, there may be used alone or in combination chromium salts such as chromium alum, aldehydes such as formaldehyde and glyoxal, N-methylol compounds, dioxane derivatives such as 2,3-dihydroxy dioxane, active vinyl compounds, and active halogen compounds such as 2,4-dichloro-6-hydroxy-S-triazine.

Photographic emulsion layers and other hydrophilic colloid layers of the photographic light-sensitive materials of the present invention may contain coating aids and surface active agents for various purposes such as impartion of antistatic properties, improvement of slipperiness, emulsification dispersing, adhesion-inhibition and improvement of photographic characteristics (such as acceleration of development, enhancement of contrast and sensitization). For example, there may be used nonionic surface active agents such as saponins (steroid type), alkylene oxide derivatives (such as polyethylene glycol and polyethylene glycol alkyl ethers), glycidol derivatives (such as polyglyceride alkenylsuccinates), fatty acid esters of polyhydric alcohols, and alkyl esters of sugars; anionic surface active agents containing acidic group such as carboxyl group, sulfo group, phospho group, sulfate ester group or phosphate ester group, for example, alkylcarboxylic salts, alkylsulfate esters, and alkylphosphate esters; ampholytic surface active agents such as amino acids, aminoalkylsulfonic acids, and aminoalkylsulfate or phosphate asters; and cationic surface active agents such as aliphatic or aromatic quaternary ammonium salts and heterocyclic quaternary ammonium salts, e.g., pyridinium and imidazolium.

The photographic light-sensitive materials used in the present invention may contain synthetic polymer decomposed products soluble or slightly soluble in water for improvement of dimensional stability in their photographic emulsion layers and other hydrophilic colloid layers. For example, there may be used polymers containing as monomer component an alkyl (meth)acrylate, an alkoxyalkyl (meth)acrylate, a glycidyl (meth)acrylate, a (meth)acrylamide, vinyl acetate, acrylonitrile, an olefin, and styrene alone or in combination or a combination of these monomers with acrylic acid, methacrylic acid, an $\alpha,\beta$-unsaturated dicarboxylic acid, a hydroxyalkyl (meth)acrylate or styrenesulfonic acid.

For obtaining photographic characteristics of super-high contrast using the silver halide light-sensitive materials of the present invention, there is no need to use the conventional lith developers or highly alkaline developers having a pH close to 13 as described in U.S. Pat. No. 2.419,975 and stable developers can be used.

That is, for the silver halide photographic light-sensitive materials of the present invention, developers which contain sulfite ion as a preservative in a sufficient amount (especially 0.15 mol/1 or more) can be used and sufficiently super-high contrast negative images can be obtained with developers having a pH of 9.5 or more, especially 10.5–12.3.

Developing agents usable in the method of the present invention have no special limitation and dihydroxybenzenes, 3-pyrazolidones, aminophenols and the like can be used singly or in combination.

Developers may further contain pH buffers such as sulfites, carbonates, borates and phosphates of alkali metals, development inhibitors and antifoggants such as bromides, iodides and organic antifoggants (especially preferably nitroindazoles and benzotriazoles). If necessary, they may further contain water softeners, dissolution aids, toning agents, development accelerators, surface active agents, antifoamers, hardeners, and inhibitors for silver staining of films (for example, 2-mercaptobenzimidazole). Examples of these additives are mentioned in Research Disclosure, No. 176, 17643 and others.

As fixers, there may be used those which have compositions as generally used. As fixing agents, there may be used, for example, thiosulfates, thiocyanates and organic sulfur compounds which are known to have the effects as fixing agents. The fixers may contain water-soluble aluminum salts and the like as hardeners.

In the present invention, there may be employed a method of processing the silver halide light-sensitive material with an alkaline activator solution by containing the developing agent in the light-sensitive material. (Japanese Patent Kokai Nos. 57-129436, 57-129433, 57-129434 and 57-129435 and U.S. Pat. No. 4,323,643). The processing temperature is normally in the range of 18°–50° C., but it may be lower than 18° or higher than 50° C. It is preferred to use automatic processors for photographic processing. According to the present invention, photographic characteristics of sufficiently super-high contrast negative tone can be obtained even when the total processing time from the light-sensitive material entering an automatic processor until it coming out of the processor is set at 60–120 seconds.

EXAMPLE 1

A silver iodobromide emulsion comprising a cubic crystal of 0.25 micron in average grain size and containing 97% of AgBr and 3% of AgI was prepared by double-jet process, washed with water, re-dissolved and then subjected to chemical sensitization with sodium thiosulfate by conventional methods. This silver iodobromide emulsion was divided into 13 portions and then thereto were added Compounds (1), (7), (13), and (16) exemplified herebefore and the following Compounds (22) and (23) as comparative compounds in the amounts as shown in Table 1. Then, each of them was coated on a polyester film at a coating amount of 3.7 g/m$^2$ in terms of silver. The thus produced film samples were subjected to exposure through a wedge and then developed with the following developer at 20° C. for 1–5 minutes.

| Developer | |
|---|---|
| Hydroquinone | 30 g |
| 4-Hydroxymethyl-4-methyl-1-phenyl-3-pyrazolidone | 0.3 g |
| Sodium sulfite | 75 g |
| EDTA.2Na | 1.0 g |
| Tripotassium phosphate | 80 g |
| Potassium bromide | 2.0 g |
| NaOH | 13 g |
| 5-Methylbenzotriazole | 0.3 g |
| 1-Diethylamino-2,3-dihydroxypropane | 17 g |
| Water to make up 11 l | |

The developer was adjusted to pH 11.5 with potassium hydroxide.

Compound (22)

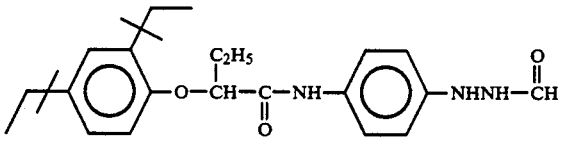

Compound (23)

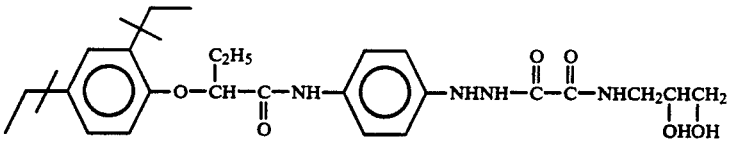

The results are shown in Table 1.

TABLE 1

| Film sample No. | Compound | Addition amount[a] | Developing Time (20° C.) 1 min Sensitivity[b] | 1 min Gamma[c] | 1 min Fog | 2 min Sensitivity[b] | 2 min Gamma[c] | 2 min Fog | 3 min Sensitivity[b] | 3 min Gamma[c] | 3 min Fog | 5 min Sensitivity[b] | 5 min Gamma[c] | 5 min Fog |
|---|---|---|---|---|---|---|---|---|---|---|---|---|---|---|
| 1 | No | | 8.1 | 4.0 | 0.00 | 9.1 | 4.0 | 0.00 | 10.0 | 4.1 | 0.00 | 10.2 | 4.1 | 0.02 |
| 2 | Compound (22) | $2.0 \times 10^{-4}$ | 25.1 | 3.0 | " | 55.3 | 8.5 | " | 76.8 | >10 | 0.05 | 111.0 | >10 | 0.10 |
| 3 | Compound (22) | $2.5 \times 10^{-3}$ | 30.2 | 3.5 | " | 75.9 | 9.0 | " | 89.1 | >10 | 0.07 | 138.0 | >10 | 0.15 |
| 4 | Compound (23) | $2.0 \times 10^{-4}$ | 63.0 | 5.5 | " | 85.5 | 9.5 | 0.01 | 90.8 | >10 | 0.05 | 110.0 | >10 | 0.16 |
| 5 | Compound (23) | $2.5 \times 10^{-3}$ | 68.5 | 6.0 | " | 90.0 | 9.5 | 0.01 | 95.0 | >10 | 0.06 | 115.5 | >10 | 0.20 |
| 6 | Compound | $2.0 \times 10^{-4}$ | 95.0 | 8.5 | " | 123.0 | >10 | 0.00 | 128.0 | >10 | 0.00 | 131.0 | >10 | 0.01 |

TABLE 1-continued

| Film sample No. | Compound | Addition amount[a] | Developing Time (20° C.) 1 min Sensitivity[b] | 1 min Gamma[c] | 1 min Fog | 2 min Sensitivity[b] | 2 min Gamma[c] | 2 min Fog | 3 min Sensitivity[b] | 3 min Gamma[c] | 3 min Fog | 5 min Sensitivity[b] | 5 min Gamma[c] | 5 min Fog |
|---|---|---|---|---|---|---|---|---|---|---|---|---|---|---|
| 7 | Compound (1) | $2.5 \times 10^{-3}$ | 101.5 | 9.0 | " | 126.5 | >10 | " | 130.0 | >10 | " | 135.0 | >10 | 0.01 |
| 8 | Compound (1) | $2.0 \times 10^{-4}$ | 98.0 | 9.0 | " | 123.0 | >10 | " | 127.5 | >10 | " | 129.5 | >10 | 0.01 |
| 9 | Compound (7) | $2.5 \times 10^{-3}$ | 99.5 | 9.5 | " | 124.0 | >10 | " | 128.5 | >10 | " | 129.5 | >10 | " |
| 10 | Compound (7) | $2.0 \times 10^{-4}$ | 79.5 | 8.5 | " | 98.0 | >10 | " | 110.0 | >10 | " | 115.0 | >10 | " |
| 11 | Compound (13) | $2.5 \times 10^{-3}$ | 82.0 | 9.0 | " | 105.5 | >10 | " | 112.5 | >10 | " | 114.5 | >10 | " |
| 12 | Compound (13) | $2.0 \times 10^{-4}$ | 99.0 | 9.0 | " | 120.0 | >10 | " | 125.5 | >10 | " | 129.0 | >10 | " |
| 13 | Compound (16) | $2.5 \times 10^{-3}$ | 100.5 | 9.5 | " | 122.5 | >10 | " | 128.9 | >10 | " | 130.0 | >10 | 0.02 |
| | Compound (16) | | | | | | | | | | | | | |

[a]Addition amount is shown by mol number per 1 mol of silver.
[b]Exposure required for giving density of 1.0 is shown as relative sensitivity. (Sensitivity of sample No. 1 when developed for 3 minutes is assumed to be 10.0).
[c]Average gradient of from density of 0.5 to 2.0 is shown in gamma.

As can be seen from Table 1, the high-contrast photographic characteristics were mostly completed even by development at 20° C. for 1 minute and besides, no increase of fog was seen even after development of long time according to the compounds of the present invention as compared with Comparative Compound (22).

It can further be seen that since change in sensitivity due to change in developing time was extremely smaller in the case of the compounds of the present invention than in the case of Comparative Compounds (22) and (23), stability against development when the compounds of the present invention were used was high.

Furthermore, when unexposed portion of each sample after subjected to development was observed, clear pepper fog occurred already after development for 3 minutes in the samples (Nos. 2–5) which contained Comparative Compounds (22) and (23) while no pepper fog was recognized in the samples (Nos. 6–13) which contained the compounds of the present invention.

EXAMPLE 2

A part of the film samples obtained in Example 1 were heated at 40° C. for 30 days and then subjected to exposure and development (for 3 minutes at 20° C.) in the same manner as in Example 1. Sensitivity and value of fog were compared with those just after coating of the emulsion. The results are shown in Table 2.

TABLE 2

| Film sample No. | Compound | Just after coating Sensitivity | Just after coating Fog | Heated at 40° C. for 30 days Sensitivity | Heated at 40° C. for 30 days Fog |
|---|---|---|---|---|---|
| 1 | No | 10.0 | 0.00 | 10.5 | 0.02 |
| 2 | Compound (22) | 75.8 | 0.05 | 80.5 | 0.10 |
| 3 | Compound (22) | 88.6 | 0.07 | 92.2 | 0.13 |
| 4 | Compound (23) | 77.9 | 0.03 | 77.5 | 0.07 |
| 5 | Compound (23) | 90.5 | 0.04 | 91.0 | 0.10 |
| 6 | Compound (1) | 128.0 | 0.00 | 128.5 | 0.01 |
| 7 | Compound (1) | 130.6 | " | 131.0 | " |
| 8 | Compound (7) | 127.5 | " | 128.0 | " |
| 9 | Compound (7) | 128.7 | " | 129.0 | " |

TABLE 2-continued

| Film sample No. | Compound | Just after coating Sensitivity | Just after coating Fog | Heated at 40° C. for 30 days Sensitivity | Heated at 40° C. for 30 days Fog |
|---|---|---|---|---|---|
| 10 | Compound (13) | 110.0 | " | 111.0 | 0.00 |
| 11 | Compound (13) | 112.5 | " | 113.5 | " |
| 12 | Compound (16) | 125.0 | " | 125.0 | 0.01 |
| 13 | Compound (16) | 128.9 | " | 130.0 | " |

As can be seen from Table 2, change in sensitivity and increase in fog with lapse of time in storage were very small when the compounds of the present invention were used.

EXAMPLE 3

Another part of the film samples obtained in Example 1 were subjected to test on dot quality. That is, each of the film samples was subjected to exposure using a gray contact screen of 150 lines through a sensitometric exposure wedge and then was developed with the same developer as above at 38° C for 30 seconds. Dot quality was evaluated. The results are shown in Table 3.

The dot quality was visually evaluated by the following 5 grades. That is, 5 means the best quality and 1 means the worst quality. The qualities of 5 and 4 are practically acceptable and that of 3 is worse, but is the lowest which is practically acceptable. The qualities of 2 and 1 are practically not acceptable.

TABLE 3

| Film sample No. | Compound | Dot quality |
|---|---|---|
| 1 | No | 1 |
| 2 | Compound (22) | 3 |
| 3 | " | 3 |
| 4 | Compound (23) | 3 |
| 5 | " | 3 |
| 6 | Compound (1) | 5 |
| 7 | " | 5 |
| 8 | Compound (7) | 5 |
| 9 | " | 5 |
| 10 | Compound (13) | 5 |
| 11 | " | 5 |
| 12 | Compound (16) | 4 |

TABLE 3-continued

| Film sample No. | Compound | Dot quality |
|---|---|---|
| 13 | " | 5 |

As can be seen from Table 3, the compounds of the present invention can give good dot quality.

As explained above, the method of image formation according to the present invention is free from the problems such as uneven development and pepper fog and can give photographic characteristics of very high contrast negative tone of more than 10 in gamma value using a stable developer.

What is claimed is:

1. A method for image formation which comprises imagewise exposing a silver halide photographic light-sensitive material comprising a support and at least one hydrophilic colloid layer including a silver halide emulsion layer and then developing it with a developer in the presence of a compound represented by the following formula (I):

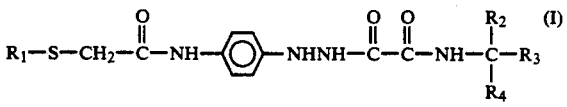

(I)

wherein $R_1$ represents an alkyl group of 1-8 carbon atoms or a cycloalkyl group having 4-8 carbon atoms in the ring, $R_2$, $R_3$ and $R_4$ may be identical or different and each represents a hydrogen atom, an alkyl group, an aralkyl group, an aryl group or a heterocyclic group with proviso that they cannot be simultaneously hydrogen atoms, $R_2$ and $R_3$ may link to each other to form a ring structure, and at least one hydroxy group is present in the substituents $R_2$, $R_3$ and $R_4$.

2. A method according to claim 1, wherein the compound represented by the formula (I) is contained in a silver halide emulsion layer or a hydrophilic colloid layer contiguous to the emulsion layer.

3. A method according to claim 2, wherein content of the compound is about $1\times10^{-6}-1\times10^{-2}$ mol for 1 mol of silver in the silver halide emulsion layer.

4. A method according to claim 1, wherein the compound represented by the formula (I) is contained in the developer.

5. A method according to claim 4, wherein content of the compound is $10^{-4}-10^{-1}$ mol/l.

6. A silver halide photographic light sensitive material which comprises a support and at least one hydrophilic colloid layer including a silver halide emulsion layer wherein said hydrophilic colloid layer contains a compound represented by the following formula (I):

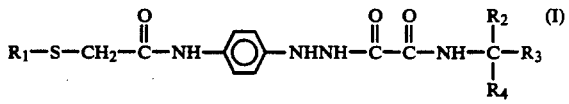

(I)

wherein $R_1$ represents an alkyl group of 1-8 carbon atoms or a cycloalkyl group having 4-8 carbon atoms in the ring, $R_2$, $R_3$ and $R_4$ may be identical or different and each represents a hydrogen atom, an alkyl group, an aralkyl group, an aryl group or a heterocyclic group with a proviso that they cannot be simultaneously hydrogen atoms, $R_2$ and $R_3$ may link to each other to form a ring structure, and at least one hydroxy group is present in the substituents $R_2$, $R_3$ and $R_4$.

7. A developer for silver halide photographic light-sensitive materials which contains a compound represented by the following formula (I):

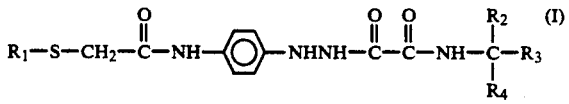

(I)

wherein $R_1$ represents an alkyl group of 1-8 carbon atoms or a cycloalkyl group having 4-8 carbon atoms in the ring, $R_2$, $R_3$ and $R_4$ may be identical or different and each represents a hydrogen atom, an alkyl group, an aralkyl group, an aryl group or a heterocyclic group with a proviso that they cannot be simultaneously hydrogen atoms, $R_2$ and $R_3$ may link to each other to form a ring structure, and at least one hydroxy group is present in the substituents $R_2$, $R_3$ and $R_4$.

* * * * *